US011427374B2

(12) United States Patent
Mondini et al.

(10) Patent No.: US 11,427,374 B2
(45) Date of Patent: Aug. 30, 2022

(54) PAPERBOARD ARTICLE FOR MAKING A CONTAINER AND CONTAINER COMPRISING THE PAPERBOARD ARTICLE

(71) Applicant: G.MONDINI S.P.A., Cologne (IT)

(72) Inventors: Giovanni Mondini, Cologne (IT); Paolo Mondini, Cologne (IT); Daniel Paderni, Castegnato (IT)

(73) Assignee: G.MONDINI S.P.A., Cologne (IT)

( * ) Notice: Subject to any disclaimer, the term of this patent is extended or adjusted under 35 U.S.C. 154(b) by 0 days.

(21) Appl. No.: 17/134,836

(22) Filed: Dec. 28, 2020

(65) Prior Publication Data

US 2022/0204209 A1 Jun. 30, 2022

(51) Int. Cl.
*B65D 5/20* (2006.01)
*B65D 5/56* (2006.01)

(52) U.S. Cl.
CPC ..... *B65D 5/2047* (2013.01); *B65D 5/563* (2013.01); *B65D 2301/00* (2013.01)

(58) Field of Classification Search
CPC ..... B65D 5/2047; B65D 5/563; B65D 2577/2025; B65D 5/56; B65D 1/34; B65D 5/209; B65D 5/246; B65D 21/0233; B65D 25/14; B65D 5/2038
USPC ..... 229/112, 125.35, 169, 406, 5.84, 186, 229/114, 198.2; 206/557, 439
See application file for complete search history.

(56) References Cited

U.S. PATENT DOCUMENTS 2,328,563 A * 9/1943 Lighter ..... G09F 23/00 206/496
2,736,065 A * 2/1956 Wilcox ..... B29C 51/162 156/160

(Continued)

FOREIGN PATENT DOCUMENTS

EP 3501813 A2 6/2019
EP 3693284 A1 8/2020

(Continued)

*Primary Examiner* — Christopher R Demeree
(74) *Attorney, Agent, or Firm* — Pearne & Gordon LLP

(57) ABSTRACT

A paperboard article (1) for making a container (8) comprises an annular frame (2), which surrounds an internal zone (20), and a plurality of wings (3) connected to the annular frame (2). Each wing (3) comprises a first portion (31) and a second portion (32), wherein the second portion (32) is connected to the annular frame (2) and is interposed between the annular frame (2) and the first portion (31). The paperboard article (1) is configured to adopt a flat configuration and an expanded configuration. In the flat configuration, the paperboard article (1) has a substantially planar shape and the wings (3) are coplanar without overlapping each other. In the expanded configuration, the paperboard article (1) has a substantially tray-like shape, wherein the annular frame (2) forms an annular flange (71), the first portions (31) of the wings (3) form a bottom wall (72) and the second portions (32) of the wings (3) form lateral walls (73). For at least one pair of wings (3), the first portion (31) of a first wing has a seat (34) and the first portion (31) of a second wing has a projection (35) that is housed in the seat (34) of the first wing: in the expanded configuration, an edge section (37) of the projection (35) makes contact with an edge section (36) of the seat (34).

18 Claims, 5 Drawing Sheets

(56) References Cited

U.S. PATENT DOCUMENTS

| | | | | |
|---|---|---|---|---|
| 3,104,012 | A * | 9/1963 | Beamish | B65D 77/22 206/438 |
| 3,135,455 | A * | 6/1964 | Santangelo | B29C 45/14475 206/438 |
| 3,358,900 | A | 12/1967 | Perdue | |
| 3,489,331 | A | 1/1970 | Andersson | |
| 3,756,495 | A | 9/1973 | Bemiss | |
| 3,917,155 | A | 11/1975 | Bemiss | |
| 4,046,310 | A | 9/1977 | Gustafsson | |
| 4,257,530 | A * | 3/1981 | Faller | B29C 51/165 229/125.35 |
| 4,351,473 | A | 9/1982 | Manizza | |
| 4,533,065 | A | 8/1985 | Chazal et al. | |
| 4,779,758 | A | 10/1988 | Chazal et al. | |
| 5,048,716 | A | 9/1991 | Bodet et al. | |
| 5,253,801 | A | 10/1993 | Bernstein et al. | |
| 5,533,623 | A | 7/1996 | Fischer | |
| 5,839,652 | A * | 11/1998 | Ben-Haim | B65D 5/2047 229/240 |
| 8,011,568 | B2 * | 9/2011 | Maeaettae | B65D 1/34 229/407 |
| 9,415,887 | B2 | 8/2016 | Zwaga et al. | |
| 9,718,576 | B2 * | 8/2017 | Moore | B65D 5/243 |
| 10,647,466 | B2 | 5/2020 | Zwaga et al. | |
| 10,689,147 | B2 * | 6/2020 | Nikolic | B65D 5/241 |
| 2004/0226850 | A1 | 11/2004 | Behnke et al. | |
| 2011/0259784 | A1 | 10/2011 | Tye et al. | |
| 2013/0327821 | A1 | 12/2013 | Zwaga et al. | |
| 2018/0022529 | A1 | 1/2018 | Tye | |
| 2020/0047940 | A1 | 2/2020 | Tye et al. | |
| 2020/0047975 | A1 | 2/2020 | Tye et al. | |
| 2020/0247571 | A1 | 8/2020 | Zwaga | |
| 2020/0255200 | A1 | 8/2020 | Mondini et al. | |
| 2020/0346794 | A1 | 11/2020 | Arbulu Ormaechea et al. | |

FOREIGN PATENT DOCUMENTS

| | | | |
|---|---|---|---|
| FR | 2406522 | A1 | 5/1979 |
| FR | 2826938 | | 1/2003 |
| FR | 2933329 | A1 | 1/2010 |
| GB | 1314148 | A | 4/1973 |
| JP | 2006290368 | A | 10/2006 |
| WO | 2012049005 | A1 | 4/2012 |
| WO | 2018017783 | A1 | 1/2018 |
| WO | 2018178508 | | 10/2018 |
| WO | 2019020863 | A2 | 1/2019 |
| WO | 2019092323 | | 5/2019 |
| WO | 2020033350 | A1 | 2/2020 |
| WO | 2020033352 | A1 | 2/2020 |
| WO | 2020120840 | A1 | 6/2020 |

* cited by examiner

PAPERBOARD ARTICLE FOR MAKING A CONTAINER AND CONTAINER COMPRISING THE PAPERBOARD ARTICLE

The present invention generally relates to the product packaging sector and specifically relates to a paperboard article for making a container, as well as a container obtained using the paperboard article.

In particular, the subject of the present invention is a paperboard article, which is to say an article made from paper, card or cardboard, which can adopt a flat configuration, in which it develops substantially in one plane, and a three-dimensional configuration, in which it can be used as a skeleton for the container.

Containers made from paperboard articles, in the sector at which the present invention is targeted, are intended, for example, for food product packaging, in particular in a controlled atmosphere. A layer of thermoplastic material is applied on the paperboard article in the three-dimensional configuration, thus obtaining the container. The food product is placed in the container and the latter is finally sealed at the top with a protective closing film.

Examples of paperboard articles already known for this purpose are described in the following documents: U.S. Pat. No. 4,533,065; WO 2012/049005 A1 WO 2018/017783 A1; WO 2019/020863 A2; and EP 3 693 284 A1;

In one type of prior-art paperboard articles (for example, WO 2012/049005 A1 and WO 2018/017783 A1), a plurality of wings is radially fixed to a central element that defines the bottom of the container. To form the container, the wings are folded relative to the central element until their edges make contact, thus forming both the lateral walls of the container and an annular flange. This type of article has the drawback that the annular flange has steps, joints or gaps that can cause problems when the thermoplastic layer or the protective closing film are fixed on it. Furthermore, the planar development of the paperboard article is much greater than the footprint of the container formed and, considering the extension of a sheet of starting material, there is a significant amount of waste.

In another type of prior-art paperboard articles (for example, EP 3 693 284 A1), there is an annular frame with its outer edge connected to wings that extend outwards from the annular frame. During the container forming process, the wings extending outwards must first be folded towards the inside of the annular frame. This construction type allows a container to be obtained that has a continuous annular flange without gaps or steps. However, even in this type of article, the planar development of the paperboard article is much greater than the footprint of the container formed and there is a non-negligible amount of waste: for example, the material inside the annular frame is not used.

Furthermore, the folding of the wings towards the inside of the annular frame, as well as entailing an additional step in the production process for the paperboard article and therefore an increase in production time, can also lead to an annular frame of variable thickness, which could be problematic for the machinery carrying out the forming.

In other prior-art types, the paperboard article is made up of several parts made separately and glued together. These are more laborious solutions, which also carry at least the same problems as highlighted above in terms of material consumption.

In this context, the technical purpose of the present invention is to produce a paperboard article for making a container that offers a solution to the issues mentioned above or, at least, offers an alternative solution to those in the prior art.

The technical purpose and the aims stated above are substantially achieved by a paperboard article for making a container in accordance with the accompanying claims.

The paperboard article according to the present invention comprises a plurality of wings connected to an annular frame. In a flat configuration wherein the wings extend into an internal zone enclosed by the annular frame, the wings are coplanar and are not overlapping each other. First portions of the wings form a bottom wall in an expanded configuration.

According to one aspect of the invention, for at least one pair of wings the first portion of a first wing has a seat and the first portion of a second wing has a projection that is housed in the seat of the first wing, in such a way that, in the expanded configuration, an edge section of the projection makes contact with an edge section of the seat.

Thanks to the contact between the wings, the bottom wall has surface continuity between the wings and, furthermore, the wings are at least partly constrained to each other. This is useful for giving greater stiffness to the bottom wall and the container.

According to another aspect, which is present at least in some embodiments, the wings are connected to an inner annular edge of the annular frame and the paperboard article can be obtained from a single sheet of material, with the material consumed being limited to the dimensions defined by the outer annular edge of the annular frame.

According to yet another aspect, the annular frame is continuous and is formed by a single layer of material. In the formed container, the annular flange is formed by the annular frame and, therefore, the annular flange is also continuous and has a constant thickness.

Further features and the advantages of the present invention will become more apparent from the detailed description of a preferred, non-limiting embodiment of a paperboard article for making a container, as illustrated in the accompanying drawings, in which.

Figure 1:
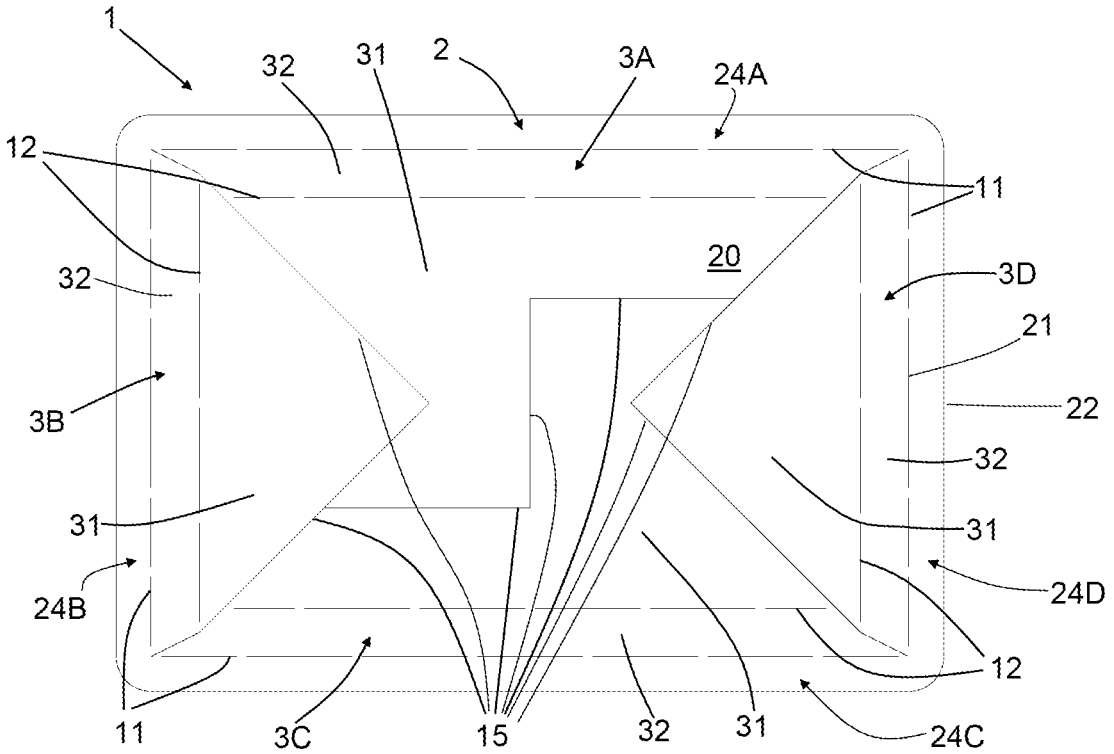
FIG. 1 shows a plan view of an embodiment of a paperboard article according to the present invention, in a flat configuration.
Figure 9:
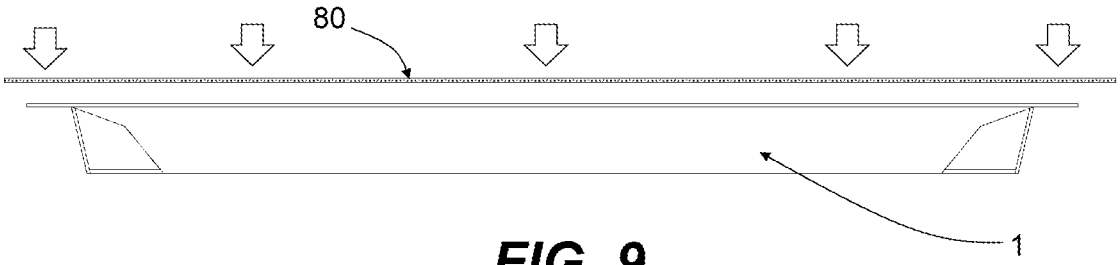
Figure 10:
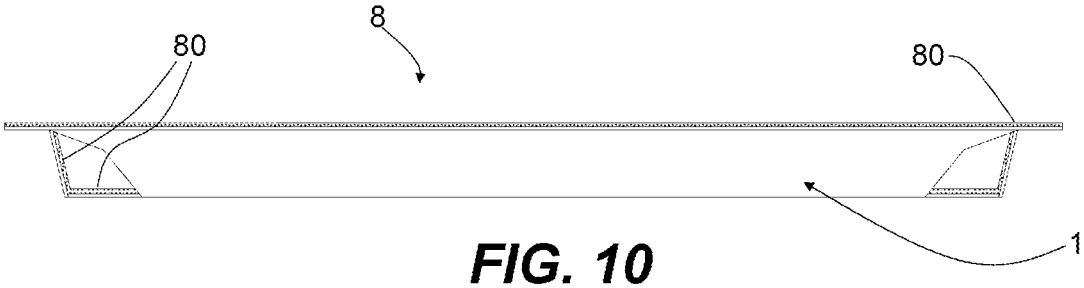
Figure 11:
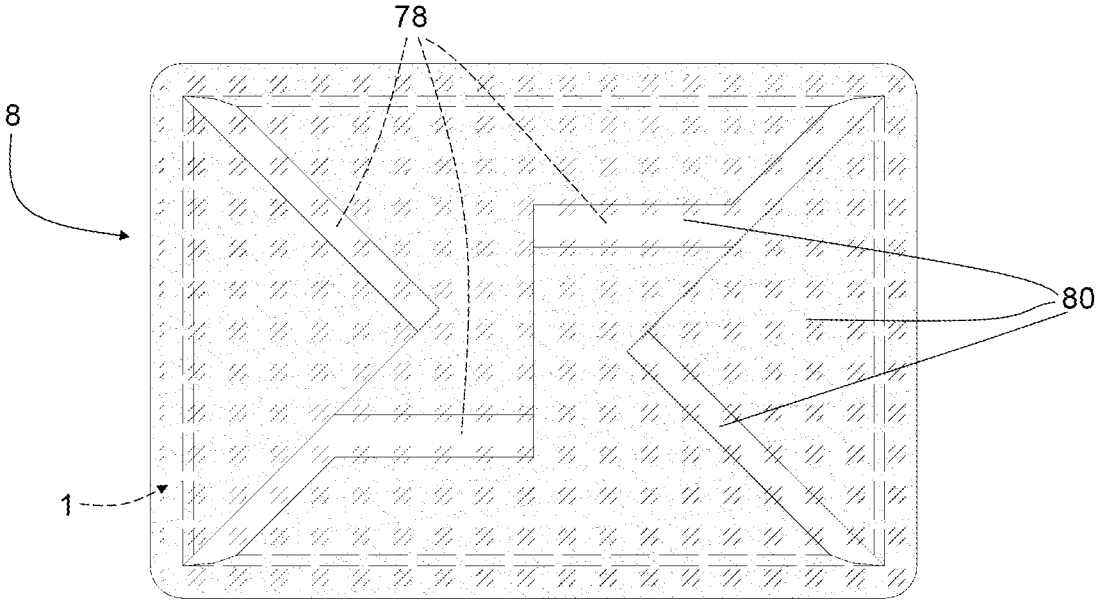
Figure 12:
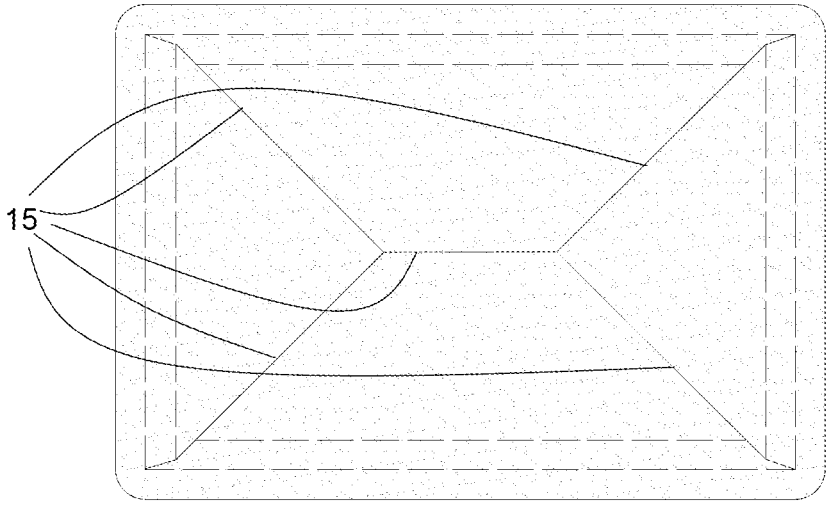
Figure 13:
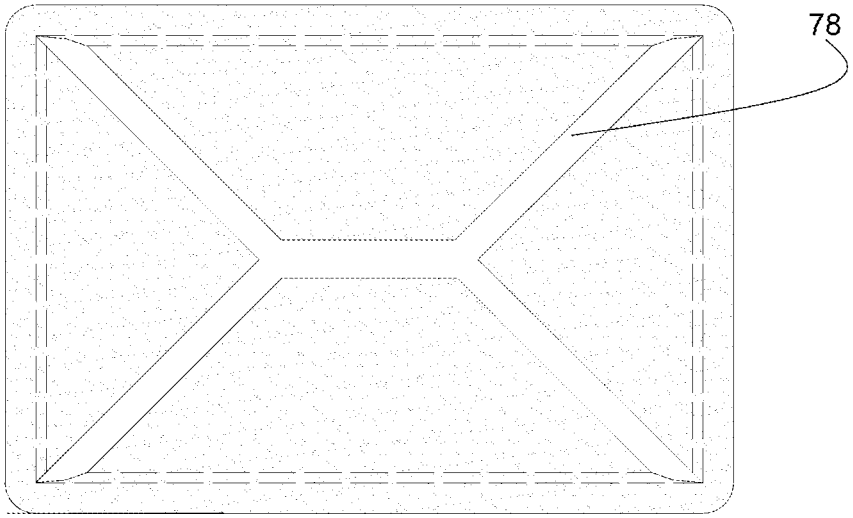

FIG. 9 schematically shows a side view of one step of making a container using the paperboard article of FIG. 1;

FIG. 10 shows a side view of a container comprising the paperboard article of FIG. 1;

FIG. 11 shows a plan view of the container of FIG. 10;

FIGS. 12 and 13 show plan views of a paperboard article—not being part of the present invention—in a flat configuration and in an expanded configuration, respectively, in which the material forming the article is shaded.

Referring to the drawings above, a paperboard article in accordance with the present invention, which is intended for making a container, has been indicated with reference number 1.

In the context of the present description, a paperboard article means an article made from paper, card or cardboard (for example, obtainable in papermaking industries or workshops) comprising at least one sheet of said material, shaped (for example, by die-cutting) in such a way as to define the various parts of interest. The paperboard article can advantageously be equipped with folding lines that allow the paperboard article to adopt, in a relatively simple way, a desired configuration. In practice, the folding lines are lines for facilitating folding, where the material is weakened and, therefore, where the folding preferentially occurs.

As will become clearer below, a paperboard article of this type can adopt a flat configuration and an expanded (or three-dimensional) configuration, the latter being the configuration for the paperboard article in use in a container; the transition from the flat to the expanded configuration occurs through a forming process, the general aspects of which are known to a person skilled in the art.

The paperboard article 1 according to the present invention comprises an annular frame 2, delimited by an inner annular edge 21 and an outer annular edge 22, and a plurality of wings 3, each connected to the annular frame 2. To distinguish the wings 3 from each other, where necessary for the purpose of the description, in some figures they are indicated with the reference numbers 3A, 3B, 3C, 3D.

The annular frame 2 surrounds an internal zone 20, which is delimited by the inner annular edge 21. Specifically, the annular frame 2 has a substantially rectangular shape with four sides 24A, 24B, 24C, 24D that are parallel in pairs. In the embodiment illustrated, the number of wings 3 is equal to the number of sides of the annular frame, which is to say only one wing is connected to each side; alternatively, at least some sides could be connected to two or more wings.

In the embodiment illustrated in the figures, the wings 3 are connected to the inner annular edge 21 of the annular frame 2 and, specifically, there is a material continuity between the annular frame 2 and the wings 3: the inner annular edge 21 is defined by first folding lines 11, which delimit the wings 3 relative to the annular frame 2.

Figure 2:
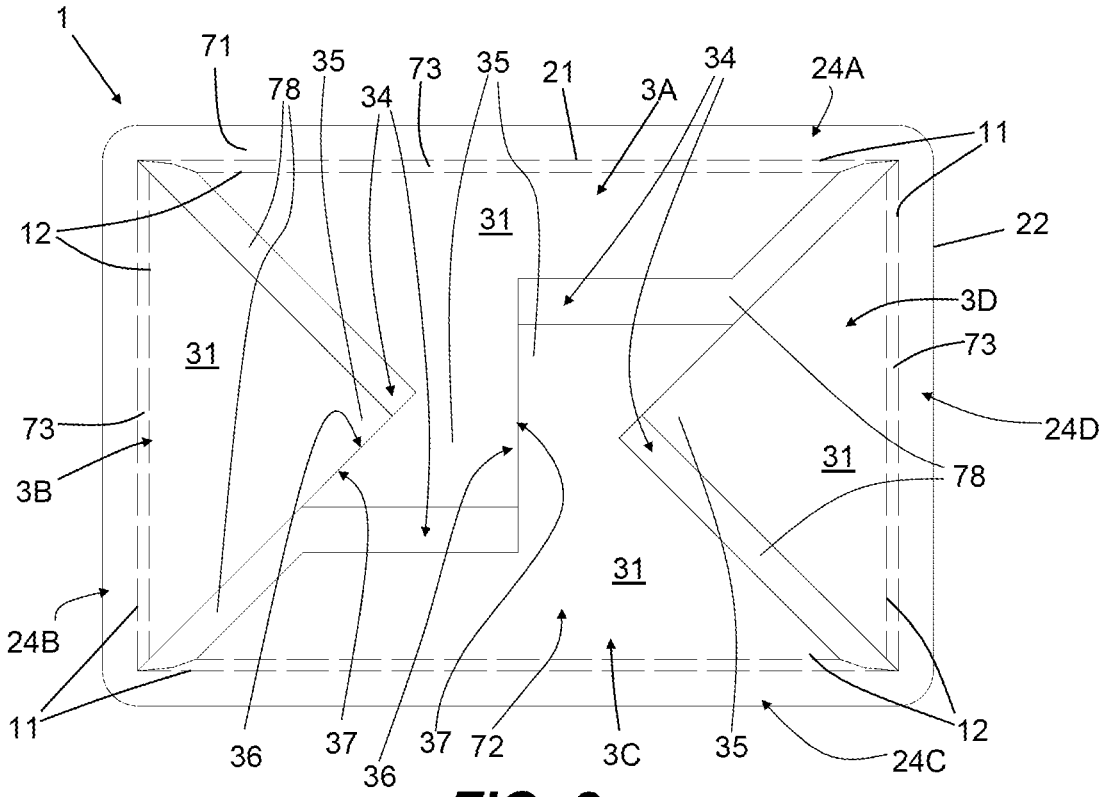
FIG. 2 shows a plan view of the paperboard article of FIG. 1, in an expanded configuration.

Each wing 3 comprises a first portion 31 and a second portion 32; the second portion 32 is connected to the annular frame 2 and is interposed between the annular frame 2 and the first portion 31. As shown in FIGS. 1 and 2, in a plan view, the second portions 32 surround the first portions 31, which are located in a central region of the internal zone 20.

In the embodiment illustrated, for each wing 3 a second folding line 12 (parallel to the first folding line 11) is interposed between the first portion 31 and the second portion 32, while the first folding line 11 is interposed between the second portion 32 and the annular frame 2. Therefore, the first portion 31 and the second portion 32 of the wings 3 are delimited by the folding lines 11, 12, as well as by a perimeter edge of the respective wing 3.

Furthermore, in the embodiment illustrated, the paperboard article 1 consists of a single sheet of material and the wings 3 are defined by cuts 15 made in the sheet of material. The cuts 15 basically create the perimeter edges of the wings 3.

Figure 3:
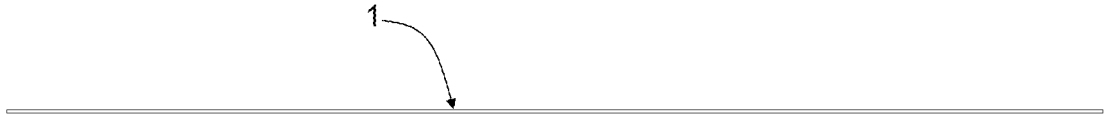
FIG. 3 shows a side view of the paperboard article of FIG. 1, in the flat configuration.
Figure 4:
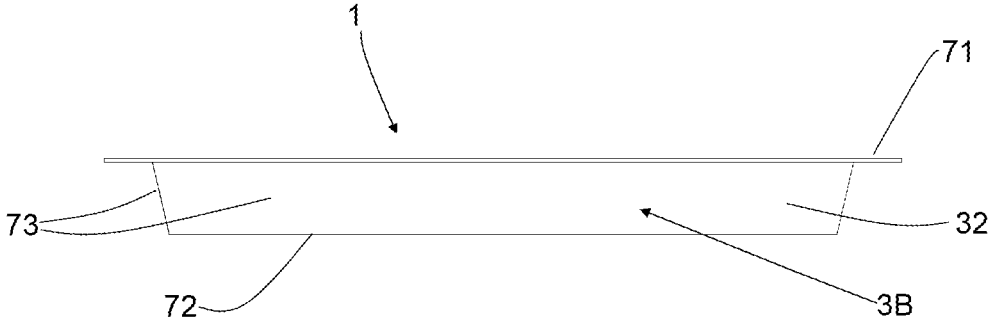
FIG. 4 shows a side view of the paperboard article of FIG. 1, in the expanded configuration.
Figure 7:
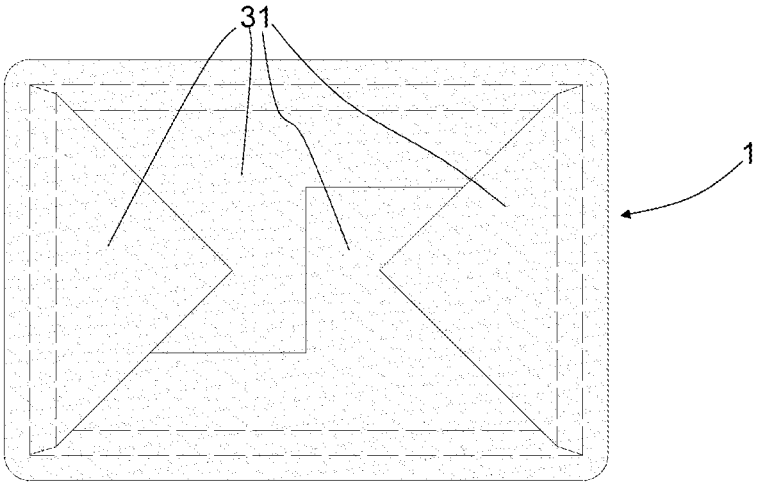
FIGS. 7 and 8 show plan views of the paperboard article of FIG. 1 in the flat configuration and in the expanded configuration, respectively, in which the material making up the article is shaded.

As mentioned above, the paperboard article 1 is configured to adopt a flat configuration (as shown in FIGS. 1, 3 and 7) and an expanded configuration (as shown in FIGS. 2, 4, 5 and 8). In FIGS. 1 and 2, the folding lines 11, 12 in the flat configuration are represented by long-long dashing lines, whereas in the expanded configuration the folds have been made and, therefore, the folding lines 11, 12 are represented by short-short dashing lines.

In the flat configuration, the paperboard article 1 has a substantially planar shape and the wings 3 extend into the internal zone 20, are coplanar and do not overlap each other. The wings 3 are adjacent and their edges touch each other (or, in other embodiments, they may be spaced apart), yet none of the wings has any part extending over another wing.

The expressions "flat configuration" and "substantially planar shape" basically mean that the paperboard article 1 in this configuration lies in a plane (i.e. the drawing plane in FIG. 1) and has a height that is significantly lower than the footprint dimensions of the paperboard article 1, which is to say its dimensions in the drawing plane. It should be noted that, to make the structure of the various parts clearer, the thickness of the sheet of material is shown to be much greater than that actually envisaged for the actual paperboard article.

In the embodiment illustrated, in which the paperboard article 1 is obtained from a single sheet of material and has no parts glued together, the wings 3 do not overlap even with the annular frame 2. Therefore, in the flat configuration, the height of the paperboard article 1 is the thickness of the sheet of material from which it was obtained, as seen in FIG. 3.

In the expanded configuration, the paperboard article 1 has a substantially tray-like shape and, basically, extends three-dimensionally and delimits an internal volume. In said configuration, the paperboard article has an annular flange 71 which extends in a first plane, a bottom wall 72 which is located in a second plane spaced apart from the first plane and a plurality of lateral walls 73 extending from the annular flange 71 to the bottom wall 72.

The annular flange 71 is formed by the annular frame 2, while the bottom wall 72 and lateral walls 73 are formed by the wings 3 that are folded relative to the annular frame 2 (in particular along the folding lines 11, 12). Specifically, the bottom wall 72 is formed by the first portions 31 of the wings 3 and the lateral walls 73 are formed by the second portions 32 of the wings 3. The annular frame 2 is continuous and, consequently, the annular flange 71 in the expanded configuration is also continuous and has a top surface that is without gaps, steps or overlaps in material.

The first portions 31 of the wings 3 are being translated relative to each other from the flat configuration to the expanded configuration, as is evident from a comparison between FIG. 1 and FIG. 2.

Basically, when transitioning from the flat configuration to the expanded configuration the wings 3 are lifted out of the plane of the annular frame 2 by folding along the first folding lines 11 and the second portions 32 of the wings 3 are positioned transversely (or even perpendicularly) to the annular frame 2.

Furthermore, the folding of the wings 3 along the second folding lines 12 (as appropriate taking into account the desired outcome) rotates the first portions 31 of the wings 3 relative to their second portions 32 and then the first portions 31 are kept in a same plane, which is distinct from and parallel to the plane of the annular frame 2. In a plan view as shown in FIGS. 1 and 2, the result is a translation of the first portions 31 outwards, which is to say towards the corresponding side of the annular frame 2 to which the respective wing 3 is connected, and therefore the first portions 31 are translated relative to each other.

One consequence of translating the first portions 31 outwards is that the surface delimited by the second folding lines 12 is greater in the expanded configuration than in the flat configuration. The difference in the surface area appears in the bottom wall 72 in the form of openings 78, due to the edges of the first portions 31 being moved apart from each other.

The present invention, by the first portions 31 being appropriately shaped, seeks to reduce the negative effects of these openings 78, such as the creation of weakened areas in the bottom wall, the gap in continuity between the first portions, and the mutual release of the first portions.

According to one aspect of the present invention, for at least one pair of wings 3 the first portion 31 of a first wing has a seat 34 and the first portion 31 of a second wing has a projection 35 which is housed in the seat 34 of the first wing.

In the expanded configuration, an edge section 37 of the projection 35 makes contact with an edge section 36 of the seat 34. Basically, the first portions 31 of the two wings have respective edges which abut against each other.

Thanks to this contact between the first wing and the second wing, in the expanded configuration the two wings are not completely spaced apart, there is local continuity of the bottom wall and, furthermore, the two wings can interlock with each other so as to at least partly hinder their relative movement.

Figure 6:
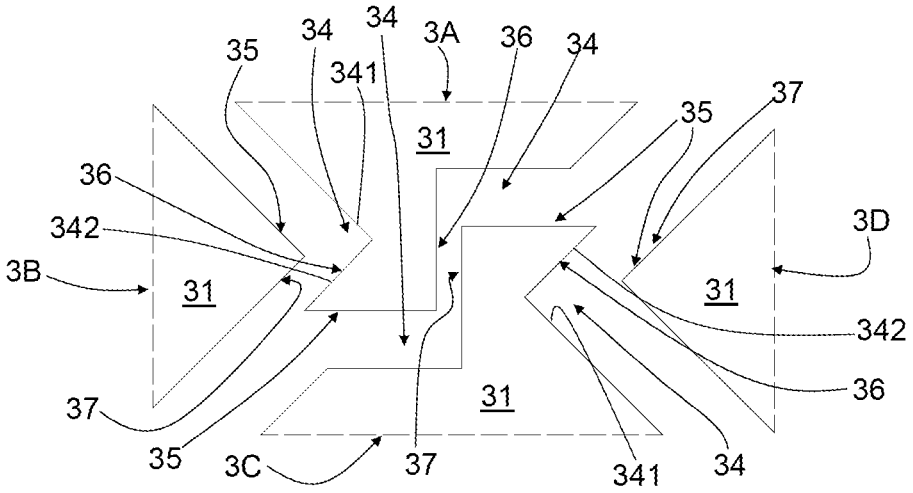
FIG. 6 shows some parts of the paperboard article of FIG. 1, detached and separated from each other.

For greater clarity, reference is made to FIG. 6, which shows only the first portions 31 of the wings 3 of FIG. 1, separated from each other as if the wings 3 had been cut along the second folding lines 12.

It should be noted that the projection 35 can simply be a vertex region of the first portion 31 (as for the wings 3B, 3D) or it can have a more complex shape, for example a trapezoid (as for the wings 3A and 3C). The seat 34 can also have different shapes, which may be simple or more complex according to the requirements; in the example illustrated, the seats 34 are delimited by two edges substantially perpendicular to each other. In practice, the seat 34 is formed by a concavity of the first portion 31, which is to say by a concave portion of the perimeter edge of the first portion 31.

With reference to FIG. 6, it should be noted that there are several pairs of wings having the characteristics indicated above: a first pair consists of the opposite wings 3A, 3C, each of them having both a seat 34 and a projection 35; a second pair consists of the consecutive wings 3A, 3B, with the projection of the wing 3B inserted in a second seat 34 of the wing 3A; a third pair similarly consists of the consecutive wings 3D, 3C.

In the embodiment illustrated, the projections 35 are already in their respective seats 34 when the paperboard article 1 is in the flat condition. The transition to the expanded condition involves a translational movement of the projections 35 inside the seats 34, in particular a partial extraction of the projections 35 from the seats 34. In other possible embodiments, the projection 35 could enter the seat 34 only during the translational movement towards the expanded condition.

In particular, the edge section 37 of the projection 35 and the edge section 36 of the seat 34 are parallel to each other or, if they are not rectilinear, have a complementary shape, so that in the expanded configuration the contact between them forms a continuous surface between the first portion 31 of the first wing and the first portion 31 of the second wing. In practice, the two portions 36, 37 are side by side or adjacent to each other and the contact extends for a certain length. In this case, "continuous surface" does not mean that the material is continuous—indeed, the two edge sections 36, 37 are side by side, yet cannot merge together—but rather that there are no evident openings between the two edge sections 36, 37.

In one specific embodiment, corresponding to that shown in the figures, the edge section 37 of the projection 35 and the edge section 36 of the seat 34 are rectilinear sections that are parallel to each other and are also parallel to a direction of relative translation of the first portion 31 of the first wing relative to the first portion 31 of the second wing from the flat configuration to the to expanded configuration. Therefore, the edge sections 36, 37 make contact in the flat configuration and in the expanded configuration; the relative translation of the first sections 31 is a sliding along said edge sections 36,37. The wing 3A and the wing 3C, connected to opposite and parallel sides 24A, 24C of the annular frame 2, form a pair of wings characterised as above: each of these has a projection 35, which faces the side 24A, 24C to which the other wing is connected, and a seat 34 that receives the projection 35 of the other wing. The contacting edge sections are the rectilinear sections 36, 37 that extend perpendicularly to said opposite sides 24A, 24C of the annular frame 2. During the movement towards the expanded condition, the first portions 31 of the two wings 3A and 3C slide relative to each other along these rectilinear sections and remain in contact with each other, as is evident from a comparison between FIGS. 1 and 2.

The wing 3A and the wing 3B, connected to consecutive sides 24A, 24B of the annular frame 2, form a pair of wings characterised as above. The seat 34 of the first wing 3A has a concavity facing the side 24B to which the second wing 3B is connected. Said seat 34 has a first edge section 341 and a second edge section 342; as can be noted in FIG. 6, the first edge section 341 is in an interposed position between the second edge section 342 and the side 24A to which the first wing 3A is connected. The projection 35 of the second wing 3B is received in the seat 34 in an interposed position between the first edge section 341 and the second edge section 342. In the expanded configuration, the edge section 37 of the projection 35 makes contact with the second edge section 342 of the seat 34, which is to say with that which is farther from the side 24A to which the first wing 3A is connected.

Furthermore, both the edge section 37 of the projection 35 and the second edge section 342 of the seat 34 are rectilinear and parallel to each other and are parallel to a direction of relative translation of the first portion 31 of the first wing 3A relative to the first portion 31 of the second wing 3B from the flat configuration to the expanded configuration. The edge sections 37, 342 make contact in the flat configuration and in the expanded configuration: during the movement towards the expanded condition, the first portions 31 of the two wings 3A and 3B slide relative to each other along these rectilinear sections 37, 342 and remain in contact with each other, as is evident from a comparison between FIGS. 1 and 2.

The description of the pair of wings 3A, 3B applies by analogy to the pair of wings 3C, 3D connected to the sides 24C, 24D.

Therefore, in the embodiment illustrated in which the frame 2 is substantially rectangular, a plurality of pairs of wings are present in which a projection of one wing is inserted into a seat of the other wing: a first pair is formed by the wings 3A, 3C connected to the mutually opposite first side 24A and second side 240; a second pair is formed by the same wing 3A of the first side 24A and by the wing 3B connected to the third side 24B interposed between the first side 24A and the second side 240; a third pair is formed by the same wing 3C of the second side 24C and by the wing 3D connected to the fourth side 24D interposed between the first side 24A and the second side 24C.

This means that, in the expanded configuration, each wing 3 has the first portion 31 that makes contact with the first portion 31 of at least one other wing 3 (in particular, the wings 3A and 3C each make contact with two other wings) and, therefore, there is surface continuity involving all the wings 3. In fact, it should be noted in FIG. 2 that this surface continuity affects a considerable part of the central region of the bottom wall 72.

It should also be noted that each of the opposite wings 3A, 3C is blocked, in a substantially wedged manner (thanks to the two edges 36 that converge towards the respective side of the frame 2), between the other of the opposite wings 3A, 3C and one of the intermediate wings 3B, 3D.

It should be considered that the same principles described above are also applicable to different embodiments, in particular in which the wings are connected to opposite or consecutive sides of an annular frame with a non-rectangular polygonal shape.

Returning to the embodiment shown in the figures, as mentioned above, the paperboard article 1 consists of a single sheet of material in which the wings are defined by cuts made in the sheet of material. Furthermore, the wings 3 are obtained from the single sheet of material without removing material in the internal zone 20 surrounded by the annular frame 2, so that, in the flat configuration, the wings 3 are adjacent to each other and have respective perimeter edges that make contact with each other along their entire extension in the internal zone 20.

Substantially, the paperboard article 1 can be obtained from a sheet of material in which the outer annular edge 22 of the annular frame 2 can be inscribed; furthermore, to create the wings 3 it is sufficient to make the cuts 15 shown in FIG. 1 in the internal zone 20, without producing any waste. This is useful for maximising the use of the raw material, which is to say the sheet of paper, card or cardboard.

Figure 8:
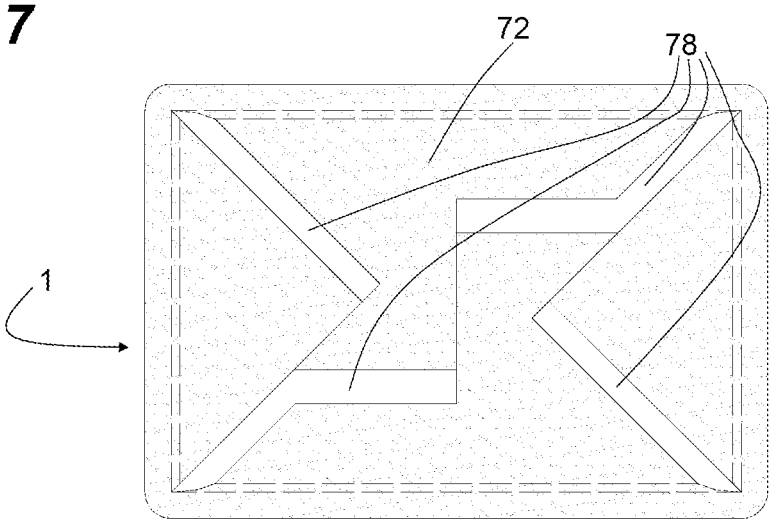

To better appreciate the advantages of the present invention, FIGS. 7 and 8 show plan views of the paperboard article 1 in the flat configuration and in the expanded configuration, respectively, in which the surfaces of the material are shaded. In FIG. 7 there is no opening, whereas in FIG. 8 the openings 78 that are created in the bottom wall 72 are evident. It should be noted that the central zone of the bottom wall 72 is continuous and involves all of the wings 3, while the openings 78 are separate from each other. This is advantageous because it allows the bottom wall 72 to maintain a good stiffness and, furthermore, the bottom wall 72 offers a substantially continuous supporting surface for the product that will be placed in the container.

For comparison, FIGS. 12 and 13 relate to a possible paperboard article (not made according to the present invention) that has the same advantage of maximising the use of the raw material, but the cuts 15 have been made according to a very simple design, so that the wings do not have seats for corresponding projections of other wings. FIG. 12 shows the flat configuration, while FIG. 13 shows the expanded configuration. The opening 78 is a single opening that directly affects the central zone and entirely separates the wings from each other. It is evident that this opening 78 deprives the bottom wall 72 of any stiffness and continuity, and leaves the wings entirely unconstrained to each other.

Figure 5:
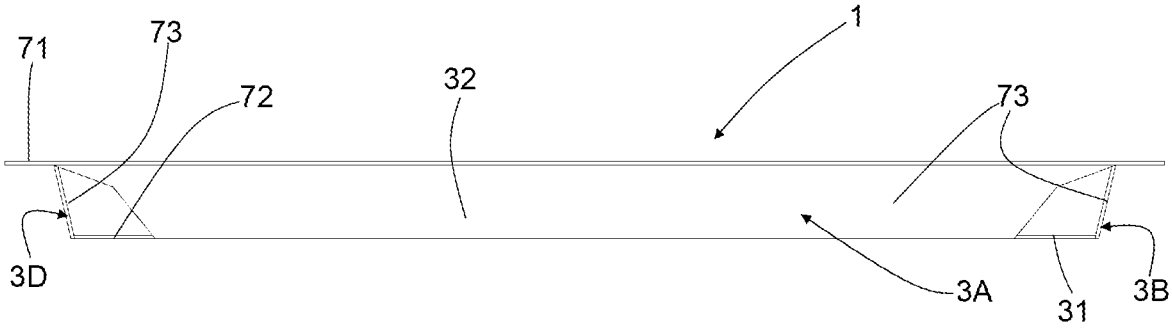
FIG. 5 shows another side view of the paperboard article of FIG. 1, in the expanded configuration.

Returning to the paperboard article 1 according to the present invention, in the embodiment illustrated the second folding lines 12 are made in such a way that, in the expanded configuration, the length of two opposite sides of the bottom wall 72 correspond to the length of the second folding lines 12 of the respective two opposite wings 3B, 3D (see FIGS. 2 and 4), while the other two opposite sides of the bottom wall 72 have a greater length than the second folding lines 12 of the respective other two opposite wings 3A, 3C (see FIGS. 2 and 5). Therefore, the vertices of the rectangle defined by the bottom wall 72 and the edges connecting them to the annular flange 71 are defined by the two opposite wings 3B, 3D rather than by empty spaces.

The paperboard article 1 according to the present invention, when in the expanded configuration, can be used as a skeleton for a container and, in particular, is intended to be coupled to a layer of material, in particular to a layer of thermoplastic material, that coats it at least in part.

This is shown schematically in FIG. 9, where reference number 80 indicates a sheet of thermoplastic material before coupling. This procedure is already known per se. For example, US 2020/0255200 A1 (U.S. patent application Ser. No. 16/272,465, in the name of the same inventors as the present application), which is incorporated herein by reference in its entirety, discloses a thermoforming device and a method for making a container that can also be used, by analogy, for the paperboard article 1 described here. FIGS. 10 and 11 show a container 8 comprising the paperboard article 1 in the expanded configuration, which constitutes a skeleton of the container, and a layer of thermoplastic material 80 that is coupled to the paperboard article 1 and at least partly coats it. Specifically, the layer of thermoplastic material 80 coats the upper face of the annular flange 71 and the inner faces of the lateral walls 73 and of the bottom wall 72, where the layer of thermoplastic material 80, being continuous, closes the openings 78 and further blocks the first portions 31 of the wings 3 to each other.

The present invention, in particular in the embodiment shown in the figures, brings important advantages.

First, thanks to the wings 3 extending from the annular frame 2 towards the inside of the annular frame in the flat configuration, the paperboard article 1 is very simple to make and the dimensions of the sheet used for its production are given by the dimensions of the outer contour of the annular frame 2, thus leading to a minimisation of the material used and a reduction in material waste.

Furthermore, the paperboard article 1 has an extension in terms of length and width which remains the same in the flat configuration and in the expanded configuration; this is useful because it allows a minimisation of the dimensions of the forming equipment compared with the prior art ones, in which the paperboard article in the flat configuration has an extension significantly greater than the paperboard article in the expanded configuration.

In addition, the annular frame 2 is continuous and has a constant thickness, thus offering a surface to which the layer of thermoplastic material 80 and/or a film closing the container can be fixed uniformly and without technical difficulties.

Moreover, thanks to the contact of the various portions of the bottom wall and consequently to the continuity of the latter, the paperboard article in the expanded configuration has a stiffness that helps to maintain its shape during use.

In summary, the structure of the paperboard article means that it does not to have portions overlapping in the flat configuration and, by having wings that extend towards the inside of the annular frame, allows material consumption (paper or cardboard) to be reduced and, in the expanded configuration, a substantially continuous bottom wall, thus not affecting the stiffness required for the bottom wall of a container.

Finally, it should be noticed that this invention is relatively easy to produce and that even the cost linked to its implementation is not very high.

The invention described above may be modified and adapted in several ways without thereby departing from the scope of the inventive concept.

All details may be substituted with other technically equivalent elements and the materials used, as well as the shapes and dimensions of the various components, may vary according to requirements.

The invention claimed is:

1. A paperboard article (1) for making a container (8), the paperboard article (1) comprising an annular frame (2), which surrounds an internal zone (20), and a plurality of wings (3), each of said wings being connected to the annular frame (2) and comprising a first portion (31) and a second portion (32), wherein the second portion (32) is connected to the annular frame (2) and is interposed between the annular frame (2) and the first portion (31);

the paperboard article (1) being configured to adopt a flat configuration and an expanded configuration;

wherein, in the flat configuration, the paperboard article (1) has a planar shape and the wings (3) extend into the internal zone (20), the wings (3) being coplanar without overlapping each other;

wherein, in the expanded configuration, the paperboard article (1) has a tray-like shape, having an annular flange (71) which extends in a first plane, a bottom wall (72) which is located in a second plane spaced apart from the first plane and a plurality of lateral walls (73), each extending from the annular flange (71) to the bottom wall (72), the annular flange (71) being formed by the annular frame (2) and the wings (3) being folded relative to the annular frame (2), so that the bottom wall (72) is formed by the first portions (31) of the wings (3) and the lateral walls (73) are formed by the second portions (32) of the wings (3), the first portions (31) of the wings (3) being translated relative to each other from the flat configuration to the expanded configuration;

wherein, for at least one pair of wings (3) of the paperboard article (1), the first portion (31) of a first wing of said at least one pair of wings (3) has a seat (34) and the first portion (31) of a second wing of said at least one pair of wings (3) has a projection (35) that is housed in the seat (34) of the first wing, wherein in the expanded configuration the first portion (31) of the first wing and the first portion (31) of the second wing are located in the second plane and a section (37) of an edge of the projection (35) makes contact with a section (36) of an edge of the seat (34).

2. The paperboard article (1) according to claim 1, wherein said edge section (37) of the projection (35) and said edge section (36) of the seat (34) are parallel to each other or have a complementary shape, so that in the expanded configuration the contact between them creates a continuous surface between the first portion (31) of the first wing and the first portion (31) of the second wing.

3. The paperboard article (1) according to claim 1, wherein said edge section (37) of the projection (35) and said edge section (36) of the seat (34) are rectilinear sections that are parallel to each other and are also parallel to a direction of relative translation of the first portion (31) of the first wing relative to the first portion (31) of the second wing from the flat configuration to the expanded configuration;

said edge sections (36, 37) making contact in the flat configuration and in the expanded configuration, the relative translation being a sliding along said edge sections (36, 37).

4. The paperboard article (1) according to claim 1, wherein the first wing (3A) and the second wing (3C) of said at least one pair of wings are connected to opposite and parallel sides (24A, 24C) of the annular frame (2), the first wing (3A) and the second wing (3C) each having a projection (35), which faces the side to which the other wing is connected, and a seat (34), which receives the projection (35) of the other wing, said contacting edge portions (36, 37) being rectilinear sections that extend perpendicularly to said opposite sides of the annular frame (2).

5. The paperboard article (1) according to claim 1, wherein the first wing (3A) and the second wing (3B) of said at least one pair of wings are connected to consecutive sides (24A, 24B) of the annular frame (2), the seat (34) of the first wing (3A) having a concavity facing the side (24B) to which the second wing (3B) is connected, the projection (35) of the second wing (3B) being received in the seat (34) in a position interposed between a first edge section (341) of the seat (34) and a second edge section (342) of the seat (34), the first edge section (341) of the seat (34) being in a position interposed between the second edge section (342) of the seat (34) and the side (24A) to which the first wing (3A) is connected, in the expanded configuration said edge section (37) of the projection (35) making contact with the second edge section (342) of the seat (34).

6. The paperboard article (1) according to claim 1, wherein the annular frame (2) has a substantially rectangular shape with four sides (24A, 24B, 24C, 24D) and the paperboard article (1) comprises a plurality of said pairs of wings (3A, 3B, 3C, 3D), wherein one first wing (3A) connected to a first side (24A) and one second wing (3C) connected to a second side (24C) opposite the first side (24A) form a first pair of wings belonging to said plurality of pairs;

one third wing (3B) connected to a third side (24B) interposed between the first side (24A) and the second side (24C) forms, together with the first wing (3A) connected to the first side (24A), a second pair of wings belonging to said plurality of pairs;

one fourth wing (3D) connected to a fourth side (24D) interposed between the first side (24A) and the second side (24C) forms, together with the second wing (3C) connected to the second side (24C), a third pair of wings belonging to said plurality of pairs.

7. The paperboard article (1) according to claim 6, wherein said edge section (37) of the projection (35) and said edge section (36) of the seat (34) are rectilinear sections that are parallel to each other and are also parallel to a direction of relative translation of the first portion (31) of the first wing relative to the first portion (31) of the second wing from the flat configuration to the expanded configuration, said edge sections (36, 37) making contact in the flat configuration and in the expanded configuration, the relative translation being a sliding along said edge sections (36, 37).

8. The paperboard article (1) according to claim 6, consisting of a single sheet of material in which the wings (3) are defined by cuts (15) made in the sheet of material, the wings (3) being obtained from the single sheet of material without removing material in the internal zone (20) surrounded by the annular frame (2), so that, in the flat configuration, the wings (3) are adjacent to each other and have their respective perimeter edges making contact with each other along their entire extension in the internal zone (20).

9. The paperboard article (1) according to claim 6, wherein in the expanded configuration: the first wing (3A) is blocked, in a substantially wedged manner, between the second wing (3C) and the third wing (3B); the second wing (3C) is blocked, in a substantially wedged manner, between the first wing (3C) and the fourth wing (3D).

10. The paperboard article (1) according to claim 1, wherein, in the expanded configuration, each wing (3) has its first portion (31) making contact with the first portion (31) of at least one other wing (3).

11. The paperboard article (1) according to claim 10, wherein in the expanded configuration there is surface continuity involving all the wings (3), this surface continuity affecting the central region of the bottom wall (72).

12. The paperboard article (1) according to claim 1, consisting of a single sheet of material in which the wings (3) are defined by cuts (15) made in the sheet of material.

13. The paperboard article (1) according to claim 12, wherein the wings (3) are obtained from the single sheet of material without removing material in the internal zone (20) surrounded by the annular frame (2), so that, in the flat configuration, the wings (3) are adjacent to each other and have their respective perimeter edges making contact with each other along their entire extension in the internal zone (20).

14. The paperboard article (1) according to claim 1, wherein the annular frame (2) has an inner annular edge (21) and an outer annular edge (22), the wings (3) being connected to the inner annular edge (21) of the annular frame (3).

15. The paperboard article (1) according to claim 1, wherein, for each wing (3), a first folding line (11) is interposed between the second portion (32) and the annular frame (2), and a second folding line (12) is interposed between the first portion (31) and the second portion (32), so that the first portion (31) and the second portion (32) are delimited by the folding lines (11, 12).

16. A container (8) comprising a paperboard article (1) according to claim 1, wherein the paperboard article (1) is in the expanded configuration and constitutes a skeleton of the container (8).

17. The container (8) according to claim 16, wherein the skeleton constituted by the paperboard article (1) is coupled to a layer of material (80), which coats it at least in part.

18. The container (8) according to claim 17, wherein the layer of material (80) is a layer of thermoplastic material.

* * * * *